US005105541A

United States Patent [19]

Messinger et al.

[11] Patent Number: 5,105,541

[45] Date of Patent: Apr. 21, 1992

[54] SHAVING AND HAIR TRIMMING APPARATUS

[75] Inventors: Werner Messinger, Kronberg; Christian Schmieder, Schwalbach, both of Fed. Rep. of Germany

[73] Assignee: Braun Aktiengesellschaft, Frankfurt, Fed. Rep. of Germany

[21] Appl. No.: 648,124

[22] Filed: Jan. 30, 1991

[30] Foreign Application Priority Data

Feb. 6, 1990 [DE] Fed. Rep. of Germany ..... 4003511

[51] Int. Cl.[5] ..... B26B 19/06; B26B 19/00

[52] U.S. Cl. ..... 30/34.1; 30/200

[58] Field of Search ..... 30/34.1, 34, 54, 60, 30/61, 63, 49, 81, 86, 51, 77, 200

[56] References Cited

U.S. PATENT DOCUMENTS

| | | | |
|---|---|---|---|
| 2,918,723 | 12/1959 | Levin | 30/200 |
| 3,008,233 | 11/1961 | Waggoner . | |
| 3,334,416 | 8/1967 | Green | 30/200 |
| 4,283,848 | 8/1981 | Messinger et al. | 30/34.1 |
| 4,393,585 | 7/1983 | Nagelkerke | 30/34.1 |
| 4,614,036 | 9/1986 | Haraguchi | 30/200 |
| 4,669,189 | 6/1987 | Ullmann | 30/200 |

FOREIGN PATENT DOCUMENTS

| | | |
|---|---|---|
| 2343116 | 1/1975 | Fed. Rep. of Germany . |
| 3714469 | 1/1988 | Fed. Rep. of Germany . |
| 63-158093 | 7/1988 | Japan . |

*Primary Examiner*—Douglas D. Watts
*Assistant Examiner*—Paul M. Heyrana, Sr.
*Attorney, Agent, or Firm*—Fish & Richardson

[57] ABSTRACT

The invention is directed to an electric shaving and hair trimming apparatus, with a first cutter arrangement or shaver assembly comprised of upper cutter and lower cutter for cutting short hair, and with a second cutter arrangement or trimmer head comprised of trimmer blade and trimmer plate for shortening long hair, with the use of the trimmer head involving a spacer comb seatable on the first and second cutter arrangement. When the apparatus is turned on, the trimmer head is invariably moved by an ON-OFF slide control means from its lowermost position (OFF position), in which its distance to the tip of the spacer comb is at a maximum, to its uppermost position in which its distance to the tip of the spacer comb is at a minimum and in which the shortest cutting length is set. In this manner, it is ensured that when starting operation of the trimmer head the beard hair is initially cut at the longest cutting length setting. This arrangement is suitable to prevent the operator from inadvertently making a deep cut in a relatively long beard already when turning the apparatus on.

9 Claims, 2 Drawing Sheets

SHAVING AND HAIR TRIMMING APPARATUS

This invention relates to a shaving and hair trimming apparatus, with a shaver assembly comprised of motor-powered upper cutter and lower cutter for cutting short hair, with a relatively spaced trimmer head comprised of trimmer blade and trimmer plate for cutting long hair, as well as with a spacer comb.

It is generally known in the art to equip shaving apparatus with a long-hair trimmer for neatening the borders of hair, such apparatus, however, being not suited to cutting relatively long hair. The entry of a major number of long hair in the space between the relatively short comb and the blade readily clogs the apparatus, causing the long-hair trimmer to stall.

Further, a combination shaver and hair trimmer is known (JP 63-158093 A) which is formed of a shaver assembly comprising a lower cutter and an upper cutter for cutting short beard hair and, arranged at a relative distance, of a trimmer head comprised of a trimmer blade and a trimmer plate, with the hair trimmer being arranged on the outside of the shaver housing. The spacer comb is adapted to slip on the trimmer head. In use, the hair trimmer is moved upwardly on the outside of the shaver into an operating position in which the trimmer head protrudes significantly over the shaver assembly. This extends the overall length of the combination shaver and trimmer in a disadvantageous manner. In addition, the spacer comb slipped on the trimmer head is capable of being extended still further upwardly to cut or trim the hair to different lengths, so that in the maximum extended position of the spacer comb the overall length of the shaving and hair trimming apparatus reaches an extreme making the apparatus very difficult to maneuver.

By contrast, it is an object of the present invention to configure and arrange a combination shaver and hair trimmer in such a manner that the combination apparatus, in addition to building to highly compact dimensions, ensures that in the use of the trimmer long hair is initially cut with the cutting length adjusted to a maximum following which the cutting length is adjustable to shorter lengths of hair.

This requirement is satisfied in that the spacer comb is adapted to be slipped over the shaver assembly and the trimmer head and to be locked in a fixed position on the housing of the shaving and hair trimming apparatus, with the trimmer head being adjustable from its lowermost operating position up to an uppermost operating position, and the distance of the trimmer head relative to the tip of the spacer comb being at a maximum when the trimmer head is in its lowermost operating position. When the trimmer head is used for cutting long hair, the spacer comb is slipped over the shaver assembly and the trimmer head. To this end, it is advantageous that, following its seating engagement with the shaving and hair trimming apparatus, the spacer comb is fixedly connected with the housing of the shaving and hair trimming apparatus, moving neither upwardly nor downwardly. Therefore, to adjust the apparatus to different cutting lengths, only the trimmer head is adjusted which for this purpose is moved by means of the slide control means. In the OFF position, the distance between the trimmer head and the tip of the spacer comb is at a maximum, so that the apparatus invariably sets to work by cutting hair at the longest cutting length setting. This eliminates the risk of inadvertently cutting the hair too short. Only by moving the slide control means from the lower setting 1 to the subsequent settings 2, 3 and 4 will the trimmer head be adjusted to progressively shorter cutting lengths with the spacer comb seated in place, with setting 4 corresponding to a position in which the cutting length is shortest. The spacer comb being located in a fixed position relative to the housing of the shaving and hair trimming apparatus, the overall length of the apparatus is not affected by an adjustment of the trimmer head to accommodate different cutting lengths, so that the combination apparatus, owing to its highly compact construction, affords excellent maneuverability.

A compact construction and ease of handling of the shaving and hair trimming apparatus is accomplished in that the trimmer head is adjustable by an ON-OFF slide control means for the electric drive of the shaver assembly and/or the trimmer head of the hair trimmer.

In a further modification of the invention, the housing of the hair trimmer is advantageously slidably mounted on the housing of the shaver for turning the common electric drive of the shaving and hair trimming apparatus on and off. A compact construction is obtained in that the hair trimmer and the slide control means form an integral unit. To facilitate shaving, the trimmer head of the hair trimmer, at least in its lowermost operating position, is advantageously outside the effective shaving range or below the shaver assembly, so as to prevent the operator from being hindered by the trimmer head while shaving. With the spacer comb removed, the trimmer head is also readily suitable for use as a long-hair trimmer for neatening the borders of hair when in its lowermost position which corresponds to setting 1.

Advantageously, the shaver assembly and the trimmer head are driven to oscillate by means of a single drive member having a laterally protruding drive finger for driving the trimmer head, the drive finger being received in a longitudinal slot which is provided in the drivable part of the trimmer blade of the trimmer head which is fixedly arranged at the upper end of the slide control means. Thus, the slide control means is readily capable of serving two functions, i.e., turning the apparatus on and moving the trimmer head into its different operating positions or settings. The slide control means may also be configured such that when moved from its OFF position to an ON position it turns the shaver assembly on simultaneously. However, it is also possible to shift the slide control means from its OFF position, for example, into a position further downwards in which only the shaver assembly is turned on. Further, the possibility exists to turn the shaving and hair trimming apparatus on and off by means of separate controls.

It is another advantage that the trimmer head is adjustable within the fixed spacer comb.

Further advantages and details of the invention will become apparent from the subsequent description and the drawings illustrating a preferred embodiment.

Figure 3:
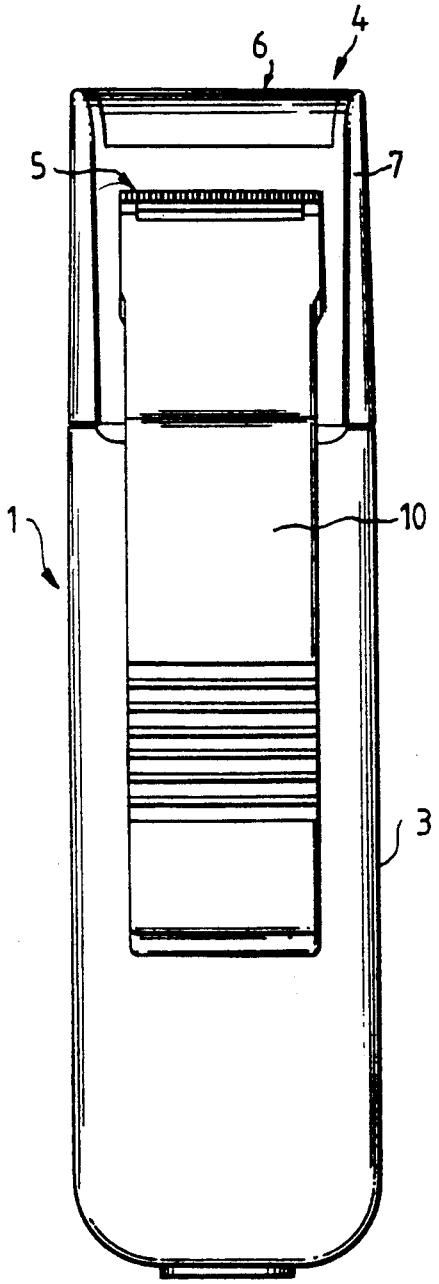
Figure 4:
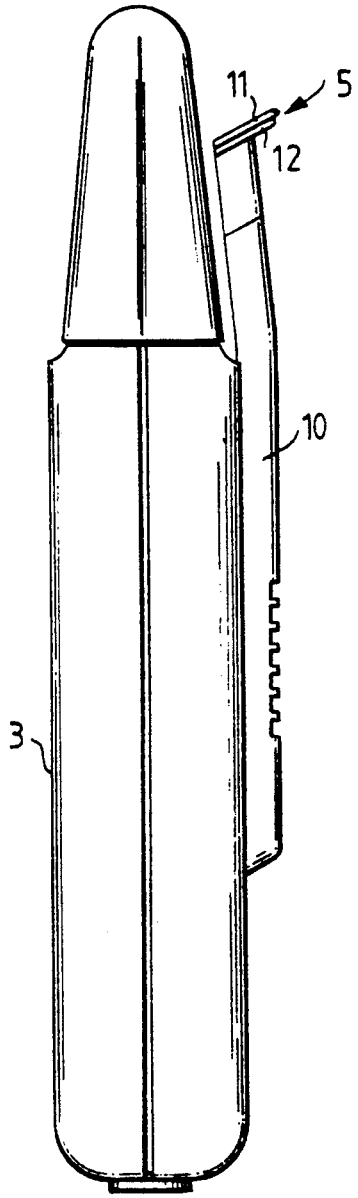

FIG. 3 is a front view of the combined shaving and hair trimming apparatus with the spacer comb removed, this illustration showing the apparatus suitable for use in shaving and shaping hair contours; and FIG. 4 is a side view of the shaving and hair trimming apparatus of FIG. 3, with the associated slide control means for adjustment of the trimmer head and for starting the apparatus being shown in its OFF position.

Referring now to the drawings, reference numeral 1 identifies a combination shaving and hair trimming apparatus comprising an elongate, slim housing 3 in which an electric motor, not shown in the drawings, is received, the motor serving to drive a shaver assembly 4 and a trimmer head 5.

As becomes apparent from FIGS. 1 to 4, the shaver assembly 4 is arranged at the top end of the housing 3, comprising a lower cutter or blade assembly not shown in the drawings and an upper cutter or cutter foil 6 mounted in a cutter foil frame 7. The cutter foil frame 7 with its cutter foil or upper cutter 6 is arranged to fit over the lower cutter and detachably connected with the upper end of the housing 3 by snapping engagement therewith.

With the component parts described, the apparatus illustrated in FIGS. 3 and 4 is only suitable for use in shaving and shaping hair contours. In transit, a spacer comb 8 serving as a guard may be fitted over the shaver assembly 4 and the trimmer head 5, thus protecting the cutter foil 6 against damage.

Figure 1:
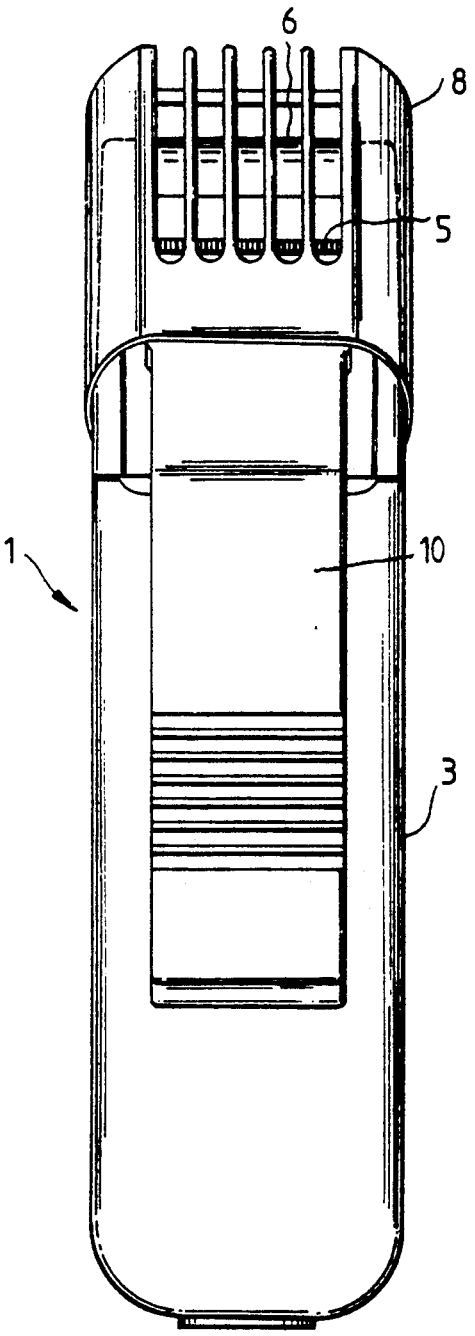
FIG. 1 is a front view of a combined shaving and hair trimming apparatus for shaving, trimming and shaping hair contours, showing a spacer comb slipped on the shaver assembly in which position the apparatus is suitable for beard care.
Figure 2:
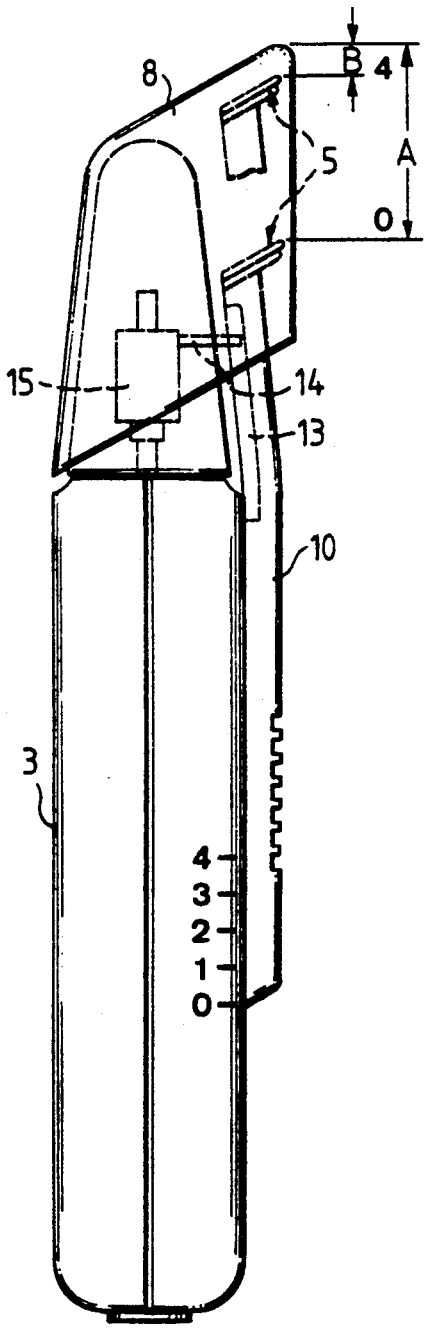
FIG. 2 is a side view of the apparatus of FIG. 1, showing the trimmer head in its lowermost as well as uppermost positions.

As becomes apparent from FIGS. 2 and 4, a slide control means 10 is slidably mounted on the side of the housing 3 and adjustable within a range A (FIG. 2) from position 0 to 4 in upward direction and from position 4 to 0 in downward direction. Moving the slide control means 10 upwardly from 0 to 1 turns the shaving and hair trimming apparatus 1 on, thus starting the shaver assembly 4. Moving the control from setting 1 to setting 2 will also activate the trimmer head 5. However, it is also possible to activate the shaver assembly separately by means of a second slide control so as to avoid that movement of the slide control means 10 into one of the settings to start the apparatus activates at the same time the lower cutter of the shaver assembly 4.

The trimmer head 5 is comprised of a trimmer plate 11 and a trimmer blade 12 (FIG. 4). As becomes apparent from FIG. 2, a longitudinal slot 13 is provided on the rear side of the slide control means 10 to receive a drive finger 14 for driving the trimmer blade 12, the drive finger causing the trimmer blade 12 to perform a reciprocating motion with the apparatus turned on. To this end, the drive finger 14 is mounted on a reciprocating drive member 15 which is provided at the upper end of the housing 3 and also serves to drive the lower cutter of the shaver assembly 4, being powered by an electric motor not shown in the drawings. The bottom end of the longitudinal slot 13 for receiving the drive finger 14 may be configured such that the drive finger 14 remains ineffective when the slide control means 10 is moved into position 1 to start the apparatus. For this purpose, for example, the longitudinal slot 13 may be provided with an enlargement so that at a specific setting of the slide control means 10 the drive finger 14 does not transmit motion to the trimmer head 5 and only the shaver assembly 4 is driven.

Advantageously, the trimmer head 5 is integrally formed with the slide control means 10. In FIG. 2, a graduated scale is provided on the housing 3 marking the settings 0 to 4. The slide control means 10 is in its OFF position identified by 0 in which the distance between the trimmer head 5 and the tip of the spacer comb 8 is at its maximum. As becomes apparent from FIG. 2, the slide control means 10 is adjustable from setting 0 (OFF position) to setting 1 (ON position) and to further settings 2, 3 and 4, with setting 4 corresponding to a position in which the distance between the tip of the spacer comb 8 and the trimmer head 5 is at its minimum. At setting 4, a maximum length of beard is cut, while a minimum length is cut at setting 1. Accordingly, moving the slide control means 10 from setting 0 to setting 1 will activate the trimmer head 5 which is then at a maximum distance relative to the tip of the spacer comb 8 as described in the foregoing, thus eliminating the risk of inadvertently cutting the hair too short when the shaving and hair trimming apparatus 1 is turned on.

As becomes apparent from FIG. 4, with the spacer comb 8 removed the trimmer head 5 is arranged so as to be an appreciable distance below the effective working range of the shaver assembly 4, the trimmer head 5 thus presenting no hindrance during shaving. The trimmer head 5 is also suitable for shaping hair contours with the spacer comb 8 removed, for which purpose the slide control means 10 only has to be moved from setting 0 to setting 1. To further facilitate maneuvering of the trimmer head 5 while shaping hair contours, it is also possible to use the trimmer head 5 at setting 4 when it is slightly above the shaver assembly 4 (see top position of trimmer head 5 in FIG. 2).

The slide control means 10 is held at the individual settings 0 to 4 by locking means not shown in the drawings.

It is also possible to move the slide control means 10 from its setting 0 in downward direction into a further setting 1—not shown—in which only the shaver assembly 4 is activated.

We claim:

1. A shaving and hair trimming apparatus comprising a housing, a shaver assembly carried by said housing, said shaver assembly including a lower cutter and an upper cutter for cutting short hair, an electric drive in said housing and coupled in driving relation to said shaver assembly, a trimmer head for cutting long hair, said trimmer head being supported on said housing for movement between a lowermost operating position and an uppermost operating position, and spacer comb structure adapted to be slipped over said shaver assembly and said trimmer head and to be locked in a fixed position on said housing, the distance of said trimmer head relative to the tip of said spacer comb structure being at a maximum when said trimmer head is in its said lowermost operating position.

2. An apparatus as claimed in claim 1 wherein said trimmer head is slidably mounted on said housing for turning said electric drive on and off.

3. An apparatus as claimed in claim 1 and further including an ON-OFF slide control for said electric drive and said trimmer head.

4. An apparatus as claimed in claim 3 wherein said trimmer head and said slide control means form an integral unit.

5. An apparatus as claimed in claim 3 wherein said trimmer head includes a trimmer blade with a longitudinal slot, in a drivable part of said trimmer blade, and said electric drive includes a laterally protruding drive finger for driving said trimmer head, said drive finger being received in said longitudinal slot of said trimmer blade trimmer head, and said trimmer head is fixedly arranged at the upper end of said slide control means.

6. An apparatus as claimed in claim 1 wherein said trimmer head, at least in its lowermost operating position, is outside the effective shaving range of the shaver assembly.

7. An apparatus as claimed in claim 6 wherein said trimmer head and said slide control means form an integral unit, said trimmer head includes a trimmer blade with a longitudinal slot, in a drivable part of said trimmer blade, and said electric drive includes a laterally protruding drive finger for driving said trimmer head, said drive finger being received in said longitudinal slot of said trimmer blade trimmer head, and said trimmer head is fixedly arranged at the upper end of said slide control means.

8. A shaving and hair trimming apparatus comprising a housing, a shaver assembly carried by said housing, said shaver assembly including a lower cutter and an upper cutter for cutting short hair, an electric drive in said housing and coupled in driving relation to said shaver assembly, and ON-OFF slide control means for said electric drive, a trimmer head comprised of a trimmer blade and a trimmer plate for cutting long hair, spacer comb structure adapted to be slipped over said shaver assembly and said trimmer head and to be locked in a fixed position on said housing, said trimmer head being adjustable from a lowermost operating position up to an uppermost operating position, the distance of said trimmer head relative to the tip of said spacer comb structure being at a maximum when said trimmer head is in its lowermost operating position, said trimmer head and said slide control means forming an integral unit, and said trimmer head being adjustable by said slide control means.

9. Apparatus as claimed in claim 8 wherein said trimmer head, at least in its lowermost operating position, is outside the effective shaving range of said shaver assembly.

* * * * *